United States Patent [19]

Satake

[11] 4,371,081

[45] Feb. 1, 1983

[54] PHOTOELECTRIC SORTING DEVICE FOR COLOR SORTING APPARATUS

[75] Inventor: Toshihiko Satake, Higashi-Hiroshima, Japan

[73] Assignee: Satake Engineering Co., Ltd., Tokyo, Japan

[21] Appl. No.: 281,230

[22] Filed: Jul. 6, 1981

[30] Foreign Application Priority Data

Jul. 7, 1980 [JP] Japan ..... 55-93023

[51] Int. Cl.[3] ..... B07C 5/342

[52] U.S. Cl. ..... 209/580; 250/239; 250/431

[58] Field of Search ..... 209/580, 581, 582, 587, 209/639, 576; 250/223 R, 239, 431, 237 R

[56] References Cited

U.S. PATENT DOCUMENTS

| | | | |
|---|---|---|---|
| 3,097,744 | 7/1963 | Hutter et al. | 209/581 X |
| 3,236,376 | 2/1966 | Boyce | 209/580 |
| 3,315,084 | 4/1967 | Bertram | 250/239 |
| 4,057,146 | 11/1977 | Castaneda | 209/581 X |
| 4,252,240 | 2/1981 | Satake | 209/639 X |
| 4,271,966 | 6/1981 | Crowley | 250/431 X |

*Primary Examiner*—Allen N. Knowles

*Attorney, Agent, or Firm*—Norbert P. Holler

[57] ABSTRACT

A photoelectric sorting device of a color sorting apparatus adapted to sort grains according to their colors. The photoelectric sorting device includes a pair of photoelectric chambers 9, 10 disposed within a grain sorting chamber 12 located under a grain chute 3 of the sorting apparatus, in such a manner that the photoelectric chambers 9, 10 opposes to each other across the flux 4 of flow of the grains coming down from the chute. Each of the photoelectric chambers 9, 10 is shielded from the grain sorting chamber by means of a transparent window plate 11 and accommodates a photoelectric detector 5, 6, 15, 17; 7, 8, 16, 18. At least one of the photoelectric chambers 9, 10 is rotatably mounted on the frame of the particle sorting chamber 12 to facilitate the cleaning of the transparent window plates 11.

2 Claims, 2 Drawing Figures

PHOTOELECTRIC SORTING DEVICE FOR COLOR SORTING APPARATUS

BACKGROUND OF THE INVENTION

The present invention relates to an improvement in photoelectric sorting device for color sorting apparatus.

Such a color sorting apparatus has been known as having a grain chute, means for supplying grains of different colors to the upper end of the chute, a grain sorting chamber disposed at the lower side of the chute, and a photoelectric sorting device disposed in the grain sorting chamber, the sorting device including a pair of photoelectric chambers each having a photoelectric detector and disposed to oppose to each other across the flux of flow of grains coming down from the chute, the photoelectric chambers being shielded from the sorting chamber by means of transparent window plates, the photoelectric sorting device further including nozzle means adapted to blow air in accordance with the output signals from the photoelectric detectors thereby to separate and sort the grains of different colors by the jet of air.

In this type of known sorting apparatus, there is a problem that the transparent window plates soon become dim due to contamination or attaching by dust powders released from the grains as the latter are blown by the air. In consequence, the amount of light projected by the light source of each photoelectric detector on the grains is reduced to seriously deteriorate the performance of the color sorting operation. To overcome this problem, a troublesome frequent cleaning of the window plates is necessary. The cleaning work is complicated and troublesome particularly when the sorting apparatus incorporates a multiplicity of nozzles of the same type arranged in a horizontal row. Furthermore, since the cleaning of the window plates necessitates a disassembling of the apparatus, the positional or dimensional precision of the parts such as the grain chute, lenses of the light-receiving elements and so forth is deteriorated in the course of the assembling after the cleaning, resulting in a lowered precision of sorting.

SUMMARY OF THE INVENTION

Accordingly, an object of the invention is to overcome the above-described problems of the prior art.

To this end, according to the invention, there is provided a photoelectric sorting device of the type explained heretofore, wherein the improvement comprises that at least one of the photoelectric chamber is rotatably mounted on a frame of the grain sorting chamber.

Therefore, in the sorting apparatus having the photoelectric sorting device of the invention, it is possible to rotate the photoelectric chambers to expose their transparent window plates to the outside to permit the cleaning of the transparent window plates when the latter has become dim due to contamination by dusts or the like. After the sufficient cleaning of the transparent window plates, the photoelectric chambers are simply rotated and reset at the operative positions without deteriorating optical precision in the photoelectric detectors. Thus, the present invention offers a great advantage of much simplified and facilitated cleaning of the transparent window plates while maintaining the high precision of the optical system, thanks to the rotatable mounting of the photoelectric chambers.

According to another aspect of the invention, the photoelectric detector in each photoelectric chamber is constituted by a light source, a light receiving element and a background.

By way of example only, an illustrative embodiment of the invention will now be described with reference to the accompanying drawings.

DESCRIPTION OF THE PREFERRED EMBODIMENTS

Figure 1:
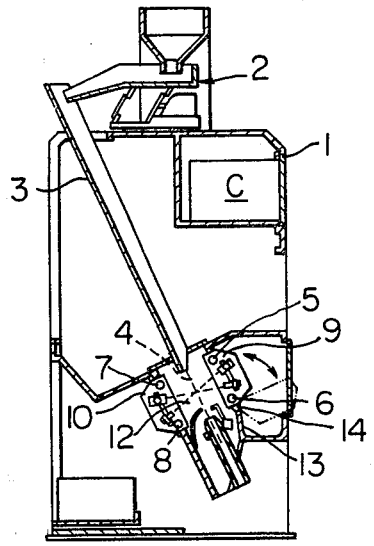
FIG. 1 is a sectional side elevational view of an embodiment of the invention.
Figure 2:
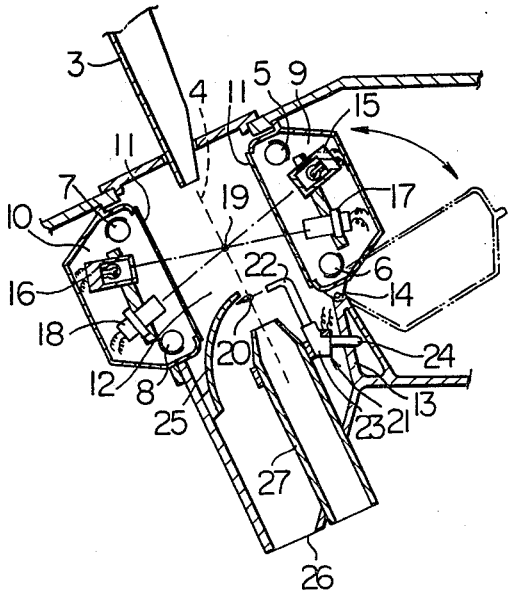
FIG. 2 is an enlarged sectional view of an essential part of the embodiment shown in FIG. 1.

Referring to FIGS. 1 and 2, a color sorting apparatus has a frame 1 on an upper portion of which mounted is a grain supplying device 2 for supplying grains of different colors to be sorted. A grain chute 3 is disposed beneath the supplying device 2 and extended at an inclination downwardly. Photoelectric chambers 9, 10 disposed at the lower side of the lower end of the chute 3 has light sources 5, 6 and 7, 8 arranged horizontally and adapted to project light beams to the flow flux 4 of the accelerated grains. The photoelectric chambers 9, 10 are shielded from a grain sorting chamber 12 by means of a dust proof transparent window plates 11, 11 facing the grain sorting chamber 12. The front side photoelectric chamber 9 is rotatably mounted on a horizontal shaft 14 on the portion of the frame 13 constituting the grain sorting chamber 12. The photoelectric chambers 9 and 10 accommodate backgrounds 15, 16 and light-receiving elements 17, 18 with focusing lenses. A nozzle device 21 has an injection nozzle 22 adapted to blow air to scatter the grains detected at the area 20 somewhat below the light projected section 19 of the flow flux 4 of the grains. The nozzle device 21 is provided with a solenoid-operated valve 23 having a solenoid circuit 24 which is connected through a control circuit C to the light-receiving elements 17, 18.

The backgrounds 15 and 16 are so adjusted that the associated light-receiving elements 18, 17 opposing thereto receive the light of the same intensity as that provided by the grains of ordinary color to be sorted. Therefore, even when there is any discontinuity or gap of flow of grains in the flow flux 4, no change of intensity of light received by the light-receiving element occurs as long as the flow flux 4 includes only the grains of the ordinary color. However, when the grains of a different color flow through the light-projected section 19, the intensity of the light received by the light-receiving element after transmission or reflection is changed. Thus, at least one of the light-receiving elements 17, 18 detects the grain of the different color and sends a detection signal to the control circuit C which in turn issues a control signal to the solenoid-operated valve 23 of the nozzle device to permit the injection nozzle 22 to blow air, so that the grains of the different color are blown away and discriminated from the grains of ordinary color.

The grains of the different color blown away by the air are guided by a guide plate 25 and are discharged to the outside of the sorting apparatus through a discharge port 26. Meanwhile, the grains of the ordinary color flow down along a collecting chute 27.

When the air is applied by the injection nozzle 22 to the grains to be sorted, not only the grains but also the dusts attaching to the grains are scattered to attach to the transparent window plates to contaminate the latter, resulting in a reduce rate of amount of transmission of the light from the light sources 5, 6 and 7, 8 which in turn degrades the sorting performance.

According to the invention, the contaminated transparent window plates can easily be cleaned by the following procedure. Namely, for cleaning the contaminated transparent window plates, the front side photoelectric chamber 9 is rotated around the horizontal shaft 14 to the position shown by two-dots-and-dash line, so as to expose the transparent window plate 11 to the outside of the frame 13 of the sorting chamber, while making the rear side photoelectric chamber 10 easily accessible for the cleaning purpose. It is, therefore, possible to clean the window plates 11 quite an easy way. After the cleaning, the photoelectric chamber 9 is simply rotated in the reverse direction to resume the position shown by the full line, to permit the restart of the sorting operation immediately after the cleaning, without any deterioration of the precision in the optical system. According to the invention, it is thus possible to maintain a high precision of the sorting operation.

The color sorting apparatus incorporating the photoelectric sorting device of the invention can have such a construction that a plurality of grain chutes 3 arrayed in the direction perpendicular to the plane of the sheet of the drawings and a plurality of nozzle devices 21 corresponding to respective chutes 3 are provided, and each photoelectric chamber includes elongated fluorescent lamps constituting the light sources 5, 6 and 7, 8, and backgrounds and light-receiving elements of the number corresponding to the number of the nozzle devices. This arrangement is quite advantageous in that it permits a multiplicity of photoelectric sorting devices are easily and simultaneously cleaned simply by rotating the front-side photoelectric chamber 9 solely.

What is claimed is:

1. In a color sorting apparatus having a grain chute, a grain supplying device disposed at the upper end of said chute and adapted to supply grains of different colors to the upper end of said chute, and a grain sorting chamber disposed at the lower side of said grain chute, said grain sorting chamber accommodating a photoelectric sorting device including a pair of photoelectric chambers each incorporating a photoelectric detector, said photoelectric chambers being disposed so as to oppose to each other across the flow flux of said grains coming down from said chute and shielded by means of transparent window plates, said photoelectric sorting device further including an injection nozzle device adapted to blow air to blow away and separate the grains of different color in accordance with the detection signal from said photoelectric detectors, an improvement in said photoelectric sorting device which comprises that at least one of said photoelectric chamber is rotatably mounted on the frame of said grain sorting chamber.

2. An improvement in the photoelectric sorting device as claimed in claim 1, wherein said photoelectric detector in each photoelectric chamber includes a light source, a light-receiving element and a background.

* * * * *